United States Patent [19]

Hedge

[11] Patent Number: 4,693,264

[45] Date of Patent: Sep. 15, 1987

[54] TREATMENT OF TOBACCO

[75] Inventor: Roger W. Hedge, Lymington, England

[73] Assignee: British-American Tobacco Company Limited, London, England

[21] Appl. No.: 873,989

[22] Filed: Jun. 13, 1986

[30] Foreign Application Priority Data

Jun. 15, 1985 [GB] United Kingdom ..... 8515217

[51] Int. Cl.[4] ..... A24B 3/18

[52] U.S. Cl. ..... 131/296; 131/304

[58] Field of Search ..... 131/296, 304

[56] References Cited

U.S. PATENT DOCUMENTS 4,407,306 10/1983 Hibbitts ..... 131/296

4,523,598 6/1985 Weiss et al. ..... 131/296

*Primary Examiner*—V. Millin

*Attorney, Agent, or Firm*—Kane, Dalsimer, Kane, Sullivan and Kurucz

[57] ABSTRACT

In the expansion of tobacco, the tobacco is entrained in hot gaseous medium, separated from the gaseous medium and re-introduced and re-entrained in the gaseous medium before being once again separated from the medium.

10 Claims, 1 Drawing Figure

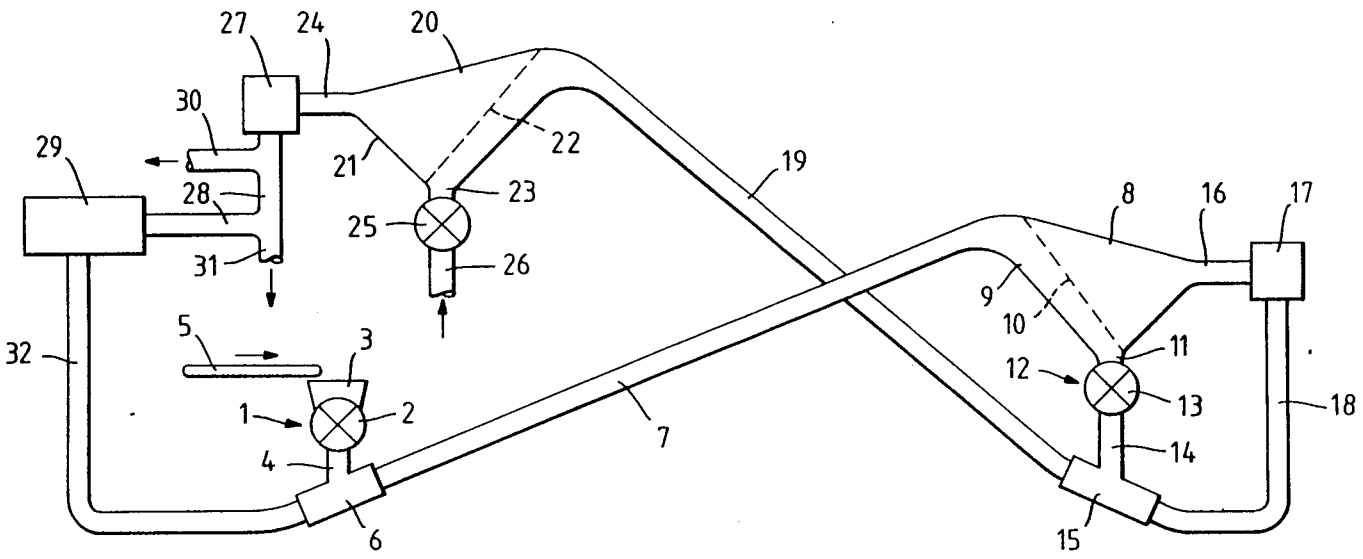
1
2
3
4
5
6
7
8
9
10
11
12
13
14
15
16
17
18
19
20
21
22
23
24
25
26
27
28
29
30
31
32

TREATMENT OF TOBACCO

BACKGROUND OF THE INVENTION

1. Field of the Invention

This invention relates to the reduction of the moisture content of particulate tobacco.

2. Brief Description of the Prior Art

Numerous particulate tobacco drying processes have been heretofore proposed. The purpose of many of these prior proposed processes is not merely to reduce the moisture content of the tobacco, but to effect also an expansion of the tobacco particles and/or an increase in the filling power of the tobacco.

A process for drying tobacco, which process effects an increase in the filling power of the tobacco is disclosed in United Kingdom Patent Specification No. 2 004 999 A. According to this process particulate tobacco is fed into a stream of hot, high humidity air. The air entrained tobacco particles are conveyed through a plurality of vertically disposed drying chambers and interconnecting ducts. Expanded tobacco and air leaving the last of the drying chambers pass to a separator operable to separate the tobacco from the air. An earlier published specification disclosing a generally similar process is United Kingdom Patent Specification No. 957,532.

A process for drying particulate tobacco according to which the tobacco is in contact with a hot drying gas for a minimal time is disclosed in U.S. Pat. No. 4,494,556. Particulate tobacco is fed into a stream of the drying gas at a location closely adjacent the point of entry of the stream into a solidsgas separator which it is stated is operable to separate the tobacco from the drying gas with a low residence time of the tobacco particles in the separator.

In European Patent Specification No. 074 059 there is disclosed a filling power improvement process in which moist particulate tobacco is fed into a stream of hot drying gas which conveys the tobacco particles through a venturi nozzle. At the throat section of the nozzle the reduced pressure causes flash evaporation of moisture in the tobacco. This results in an expansion of the tobacco particles. From the venturi nozzle the drying gas and the tobacco entrained therewith flow through a vertically disposed drying chamber and then into a cyclone separator.

A similar process to that of Specification No. 074 059 is disclosed in United Kingdom patent Specification No. 2 111 820 A.

In a tobacco expansion process disclosed in United Kingdom Patent Specification No. 1,382,839 particulate tobacco which has been subjected to a microwave field is fed into a stream of hot gas which conveys the tobacco, under the action of a first fan, to a first separator. The tobacco separated in the first separator from the hot gas is fed into a stream of cool gas which, under the action of a second fan, conveys the tobacco to a second separator.

A particulate tobacco conditioning apparatus which is disclosed in United Kingdom Patent Specification No. 1,389,452 comprises a vibratory conveyor which extends through three treatment chambers. The conveyor is of air permeable construction and fan means is provided by operation of which a stream of hot air can be introduced into the first treatment chamber beneath the conveyor. The hot air passes up through the conveyor and the tobacco thereon, causing an agitation of the tobacco, before passing from the first treatment chamber into a pipe which conveys the air to the second treatment chamber beneath the run of the conveyor therewithin. After passing up through the conveyor and the tobacco in the second chamber, the air is conveyed to the space beneath the run of the conveyor in the third chamber. The air leaves the third chamber through an exhaust outlet open to atmosphere, having in the third chamber once again passed upwardly through the tobacco.

The prior proposed processes in which particulate tobacco is conveyed in a stream of gaseous medium to dry the tobacco, suffer from one or more of three defects, namely (1) an over-long and continuous exposure of the tobacco to a hot gaseous medium, (2) too intensive a heating regime and (3) after the lapse of a short acceleration period, absence of differentation in the velocity of the tobacco particles and the conveying gaseous medium. The first and second of these defects can have a deleterious effect on the tobacco and on the final filling power thereof. The third defect results in a reduced rate of heat and mass transfer.

It is an object of the present invention to provide a method of drying particulate tobacco whereby the above identified defects of the prior tobacco drying proposals are avoided or at least significantly diminished.

SUMMARY OF THE INVENTION

The present invention provides a method of reducing the moisture content of particulate tobacco, wherein particulate tobacco is fed into a stream of hot gaseous medium, said medium conveys said tobacco through a first duct to a first separator, said tobacco is separated from said medium in said first separator, said medium passes from said first separator to a second duct, said tobacco is fed from said first separator into the stream of said medium downstream of said first separator, whereby said medium conveys said tobacco through said second duct to a second separator, and said tobacco is separated from said medium in said second separator.

When particulate tobacco is treated in accordance with the present invention, the tobacco is twice subjected to acceleration by the gaseous medium, once in the first duct and once in the second duct. Intermediate its passage through the first and second ducts the tobacco is maintained for a period out of contact with the gaseous medium. Preferably, delay means is employed to extend this period to a time value greater than it would otherwise be. Advantageously the delay means is adjustable to provide for selection of the residence time of the tobacco particles therein.

Cut stem tobaccos, cut lamina tobaccos or blends thereof may be treated in accordance with the present invention.

The gaseous medium may be, for example, steam, air, steam and air, or nitrogen.

According to another aspect of the present invention there is provided tobacco drying apparatus comprising a first duct, a first gas-flow passage in communication at a downstream end thereof with an upstream end of said first duct, a first tobacco feed path extending to and opening into said first gas-flow passage, first separator means in communication with a downstream end of said first duct, a second duct, a second gas-flow passage in communication at a downstream end thereof with an upstream end of said second duct, a second tobacco feed path extending from said first separator means to and opening into said second gas-flow passage, a gas-flow pipe extending from said first separator means and being in communication with the upstream end of said second gas-flow passage, and second separator means in communication with the downstream end of said second duct, said first separator means being functionable to receive gaseous medium and tobacco from said first duct, to permit said gaseous medium to pass substantially absent said tobacco to said gas-flow pipe and to permit said tobacco to pass substantially absent said gaseous medium to said second tobacco feed path. Preferably, variable residence time means is disposed in the second tobacco feed path and is operable to adjust selectively the residence time of tobacco particles in the second feed path.

Apparatus may be provided in accordance with the present invention which apparatus is comparatively inexpensive, compact, simple in construction and readily operable.

BRIEF DESCRIPTION OF THE DRAWINGS

In order that the present invention may be clearly understood and readily carried into effect, reference will now be made, by way of example, to the diagrammatic drawing hereof, which shows a tobacco expansion apparatus.

DETAILED DESCRIPTION OF THE PREFERRED EMBODIMENTS OF THE INVENTION

The tobacco expansion apparatus shown in the diagrammatic drawing comprises a first tobacco feeder, generally designated 1, which provides a first tobacco feed path. The feeder 1 is comprised of a rotary airlock 2 fitted with an inlet hopper 3 and a downwardly extending outlet pipe 4. A feed conveyor 5 is operable to feed particulate tobacco to the inlet hopper 3. At its lower end, the outlet pipe 4 opens into a first gas-flow passage in the form of a short length of piping 6. At an outlet end theeof the piping 6 communicates with an upwardly inclined expansion pipe 7 which provides a first duct.

At its higher end, the pipe 7 opens into the interior of a casing 8 of a first separator 9. Extending across the interior of the casing 8, so as to divide the interior into two sections, is a mesh screen 10. A short outlet pipe 11 extends downwardly from a lowermost location of the separator 9. The pipe 11 serves to intercommunicate that section of the interior of the casing 8 which is to the side of the mesh screen 10 at which the pipe 7 opens into the casing 8, with a second tobacco feeder, generally designated 12.

The second tobacco feeder 12, which provides a second tobacco feed path, is comprised of a rotary airlock 13 and an outlet pipe 14 which extends downwardly from the airlock 13 and opens into a second gas-flow passage in the form of a short length of piping 15.

To the side of the mesh screen 10 of the separator 9 remote the pipes 7 and 11 a further outlet pipe 16 serves to intercommunicate the interior of the casing 8 with the inlet of a centrifugal fan 17. A gas-flow pipe 18 extends from the outlet of the fan 17 to an inlet end of the piping 15.

The outlet end of the piping 15 communicates with an upwardly inclined expansion pipe 19 which provides a second duct.

At its higher end, the pipe 19 opens into the interior of a casing 20 of a second separator 21. The separator 21 is of similar construction to the separator 9 and comprises a mesh screen 22 dividing the interior of the casing 20 into two sections, a short outlet pipe 23 to the same side of the mesh 22 as is the opening of the pipe 19, and a further outlet pipe 24 to the other side of the mesh screen 22. The outlet pipe 23 serves to intercommunicate the interior of the casing 20 with a rotary airlock 25 from which there downwardly extends a discharge pipe 26.

The outlet pipe 24 serves to intercommunicate the interior of the casing 20 of the separator 21 with the inlet of a centrifugal fan 27. From the outlet of the fan 27 a pipe 28 extends, first downwardly and then horizontally, to a heater 29. An exhaust pipe 30 branches from the pipe 28 and a steam make-up pipe 31 communicates with the pipe 28 at a location intermediate the branching location of the pipe 30 and the heater 29.

The heater 29, which may, for example, be gas or oil fired, is operable to heat the steam/air mixture (hereinafter referred to as "gaseous medium") delivered from the pipe 28. An outlet pipe 32 serves to convey gaseous medium which has been heated in the heater 29 to the inlet end of the piping 6.

In operation of the apparatus to expand particulate tobacco, cut stem tobacco for example, gaseous medium flow is established in the apparatus aided by operation of the centrifugal fans 17 and 27. The tobacco is fed to the inlet hopper 3 from the feed conveyor 5 and passes through the rotary airlock 2, driven by rotary drive means (not shown), and the outlet pipe 4 to the piping 6. In the piping 6 the tobacco particles are entrained by the gaseous medium which is conveyed to the-piping 6 in the pipe 32 extending from the heater 29. It is preferable, in order to promote the entrainment of the tobacco particles, for the interior of the piping 6 to be of a venturi configuration with the pipe 4 opening at the throat thereof.

The gasous medium conveys the tobacco particles along the pipe 7 to the first separator 9, the mesh screen 10 of which permits passage of the gaseous medium to the fan 17 but constrains the tobacco particles to pass downwardly to the airlock 13. The tobacco passes through the airlock 13, driven by rotary drive means (not shown), and through the outlet pipe 14 to the piping 15. In the piping 15 the tobacco particles are entrained by gaseous medium which is conveyed to the piping 15, preferably without the gaseous medium being subjected to re-heating, in the gas-flow pipe 18 extending from the fan 17.

The gaseous medium conveys the tobacco particles along the pipe 19 to the second separator 21, the mesh screen 22 of which permits passage of the gaseous medium to the fan 27 but constrains the tobacco particles to pass downwardly to the airlock 25, driven by rotary drive means (not shown). The tobacco particles pass from the airlock 25 through the discharge pipe 26 to a receptacle or a conveyor (not shown). The tobacco particles are subsequently subjected to a cooling step which is in accordance with established practice and which, for the sake of simplicity, is not further discussed.

From the fan 27 the gaseous medium passes along the pipe 28 to the heater 29 in which the heat given up by the gaseous medium during the passage thereof through the apparatus is replaced. Gases and water vapour generated in the apparatus and air which has entered the apparatus through the airlocks 2, 13 and 25 are removed via the exhaust pipe 30. Make-up steam can be supplied, from a steam generator (not shown), via the make-up pipe 31.

The apparatus which is comparatively inexpensive, compact and simple in construction and operation, provides a very efficient means of drying and expanding particulate tobacco. As soon as the tobacco enters the piping 6, the tobacco particles are accelerated by the gaseous medium. Thus as the particles are conveyed up the pipe 7 by the gaseous medium, the velocity differential between the tobacco particles and the gaseous medium diminishes. However, the separation of the tobacco and the gaseous medium effected in the separator 9 and the reintroduction of the tobacco into the gaseous medium in piping 15 means that the process of acceleration of the tobacco is repeated. This means thst there is a velocity differential between the tobacco and the gaseous medium over a greater period of time than would be the case if the tobacco passed along a single, straight expansion pipe, of a length equivalent to the combined lengths of pipes 7 and 19, without an intermediate reacceleration. Thus in comparison with an apparatus comprising a single expansion pipe of equivalent length, the apparatus shown in the drawing effects heat and mass transfer at enhanced efficiency levels.

Moreover, the separation of the tobacco particles from the hot gaseous medium intermediate the passage of the particles in contact with the medium in the first and second expansion pipes 7, 19 permits a degree of moisture migration to take place in each particle towards the surface of the particle and ensures that the rigour of the heating regime to which the particles are subjected is less than would otherwise be the case. This has benefits in terms of the filling power of the tobacco which passes from the apparatus through discharge pipe 26.

In order to obtain adjustment of the residence time of the tobacco in the airlock 13, the drive means thereof is preferably of a variable speed type.

In order to minimise the overall time during which the tobacco is in contact with the hot gaseous medium, which overall time may be, for example, of the order of one second, it is important that the mean residence time of the tobacco particles in the separators is short and that there is only a narrow statistical distribution of residence times of the particles in the separators. This requirement is met by the separators 9 and 21 which are of a type supplied by Hambro Machinery Limited, Nottingham, England. Cyclone separators would meet the requirement less well.

Although, as above described, the apparatus is operated without re-heating of the gaseous medium in its passage from the fan 17 to the piping 15, it is conceivable to provide such a re-heating step.

As an alternative to the tobacco passing via the pipe 14 directly from the airlock 13 to the piping 15, it may be fed from the airlock 13 onto a conveyor (not shown), from which the tobacco passes into the piping 15 through a further airlock (not shown). In such case the conveyor and/or the further airlock can provide a delay function in addition to, or in place of, that of the airlock 13. The conveyor and/or the further airlock may be provided with variable speed drive means.

What is claimed is:

1. A method of reducing the mositure content of particulate tobacco wherein particulate tobacco is fed into a stream of hot gaseous medium, said medium conveys said tobacco through a first duct to a first separator, said tobacco is separated from said medium in said first separator, said medium passes from said first separator to a second duct, said tobacco is fed from said separator into the stream of said medium flowing in said second duct downstream of said first separator, whereby said medium conveys said tobacco through said second duct to a second separator, and said tobacco is separated from said medium in said second separator.

2. A method according to claim 1, wherein after said medium has passed from said first separator but before said medium re-encounters said tobacco, said medium is heated.

3. A method according to claim 1, wherein said tobacco, after passing from said first separator and before re-encountering said medium, is subjected to flow delay.

4. A method according to claim 1, wherein the filling power of said tobacco at exit from said second separator is greater than the filling power of said tobacco when fed into said stream of gaseous medium upstream of said first separator.

5. Tobacco drying apparatus comprising a first duct, a first gas-flow passage in communication at a downstream end thereof with an upstream end of said first duct, a first tobacco feed path extending to and opening into said first gas-flow passage, first separator means in communication with a downstream end of said first duct, a second duct, a second gas-flow passage in communication at a downstream end thereof with an upstream end of said second duct, a second tobacco feed path extending from said first separator means to and opening into said second gas-flow passage, a gas-flow pipe extending from said first separator means and being in communication with the upstream end of said second gas-flow passage, and second separator means in communication with the downstream end of said second duct, said first separator means being functionable to receive gaseous medium and tobacco from said first duct, to permit said gaseous medium to pass substantially absent said tobacco to said gas-flow pipe and to permit said tobacco to pass substantially absent said gaseous medium to said second feed path.

6. Apparatus according to claim 5, wherein said second feed path comprises flow delay means.

7. Apparatus according to claim 6, wherein said delay means is adjustable to provide for selection of residence time of said tobacco therein.

8. Apparatus according to claim 6, wherein said delay means comprises an airlock.

9. Apparatus according to claim 5, and further comprising heating means operable to heat gaseous medium in said gas-flow pipe.

10. Apparatus according to claim 5, and further comprising supply means operable to supply hot gaseous medium to said first gas-flow passage at the upstream end thereof.

* * * * *